US007173482B2

(12) United States Patent
Lobb et al.

(10) Patent No.: US 7,173,482 B2
(45) Date of Patent: Feb. 6, 2007

(54) CMOS REGULATOR FOR LOW HEADROOM APPLICATIONS

(75) Inventors: Katherine Ellen Lobb, Stewartville, MN (US); Patrick Lee Rosno, Rochester, MN (US); James David Strom, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 92 days.

(21) Appl. No.: 11/094,711

(22) Filed: Mar. 30, 2005

(65) Prior Publication Data

US 2006/0220730 A1 Oct. 5, 2006

(51) Int. Cl.
*G05F 1/10* (2006.01)

(52) U.S. Cl. ..... 327/541; 327/563

(58) Field of Classification Search ..... 327/535, 327/537, 538, 540, 541, 543, 561, 562, 563
See application file for complete search history.

(56) References Cited

U.S. PATENT DOCUMENTS

| | | | | |
|---|---|---|---|---|
| 5,721,485 | A * | 2/1998 | Hsu et al. | 713/323 |
| 5,880,627 | A * | 3/1999 | Thiel, V | 327/562 |
| 6,313,694 | B1 * | 11/2001 | Sohn | 327/541 |
| 6,456,155 | B2 * | 9/2002 | Takai | 327/541 |
| 6,624,685 | B2 * | 9/2003 | Shih et al. | 327/541 |
| 6,686,797 | B1 * | 2/2004 | Eker | 327/539 |

* cited by examiner

*Primary Examiner*—Jeffrey Zweizig
(74) *Attorney, Agent, or Firm*—Joan Pennington

(57) ABSTRACT

A complementary metal oxide semiconductor (CMOS) voltage regulator for low headroom applications includes a differential input common mode range amplifier. The differential input common mode range amplifier is formed by a plurality of CMOS transistors. A source follower CMOS transistor is coupled to an output of the differential input common mode range amplifier for providing an output of the CMOS voltage regulator. A current source is coupled to the differential input common mode range amplifier for maintaining a bias current through the differential input common mode range amplifier.

14 Claims, 3 Drawing Sheets

CMOS REGULATOR FOR LOW HEADROOM APPLICATIONS

FIELD OF THE INVENTION

The present invention relates generally to the field of design of semiconductor devices, and more particularly, relates to a complementary metal oxide semiconductor (CMOS) voltage regulator for low headroom applications.

DESCRIPTION OF THE RELATED ART

Problems arise with conventional regulator arrangements when using low power supply voltages. For example, a power supply running at less than a nominal voltage can interfere with the normal operation of a regulator, particularly when using an NMOS source follower in a feedback loop of the regulator. To supply enough current at the output of the regulator, an amplifier output driving the gate of the NMOS source follower must be equal to the input voltage plus the gate to source voltage Vgs of the NMOS source follower.

When a power supply is not guaranteed to run at a nominal voltage and, for example, could be as much as 10% below nominal voltage, this leaves very little headroom for the amplifier and typically results in a regulator with very poor power supply rejection (PSR) and/or a lowered output voltage.

One known solution to these problems is to raise the power supply voltage, which is not always possible. Another known solution is to lower the regulator output, which will not work for some needed applications. Another known solution is to increase the width of the NMOS source follower in the feedback loop of the regulator for lowering the gate to source voltage Vgs. However, this solution may be limited by chip size. Another known solution is to use a PMOS source follower. However, the PMOS source follower will need to be much bigger for the same application, and this solution also may be limited by chip size.

A need exists for an effective complementary metal oxide semiconductor (CMOS) voltage regulator for low headroom applications.

SUMMARY OF THE INVENTION

A principal aspect of the present invention is to provide a complementary metal oxide semiconductor (CMOS) voltage regulator for low headroom applications. Other important aspects of the present invention are to provide such CMOS voltage regulator for low headroom applications substantially without negative effect and that overcome some of the disadvantages of prior art arrangements.

In brief, a complementary metal oxide semiconductor (CMOS) voltage regulator for low headroom applications includes a differential input common mode range amplifier. The differential input common mode range amplifier is formed by a plurality of CMOS transistors. A source follower CMOS transistor is coupled to an output of the differential input common mode range amplifier for providing an output of the CMOS voltage regulator. A current source is coupled to the differential input common mode range amplifier for maintaining a bias current through the differential input common mode range amplifier.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the preferred embodiments, the CMOS regulator of the preferred embodiment includes a wide input common mode range amplifier that is biased by a current source to provide increased dynamic range and improved power supply rejection (PSR) at lower power supply voltages. As the current increases, the amplifier gain increases, and the PSR improves or is lower. For example, as illustrated and described with respect to FIG. 3, a maximum PSR of the CMOS regulator of the preferred embodiment is 3 to 6 dB lower than a conventional regulator design at a positive voltage supply rail VDD of 1.62V.

Figure 1:
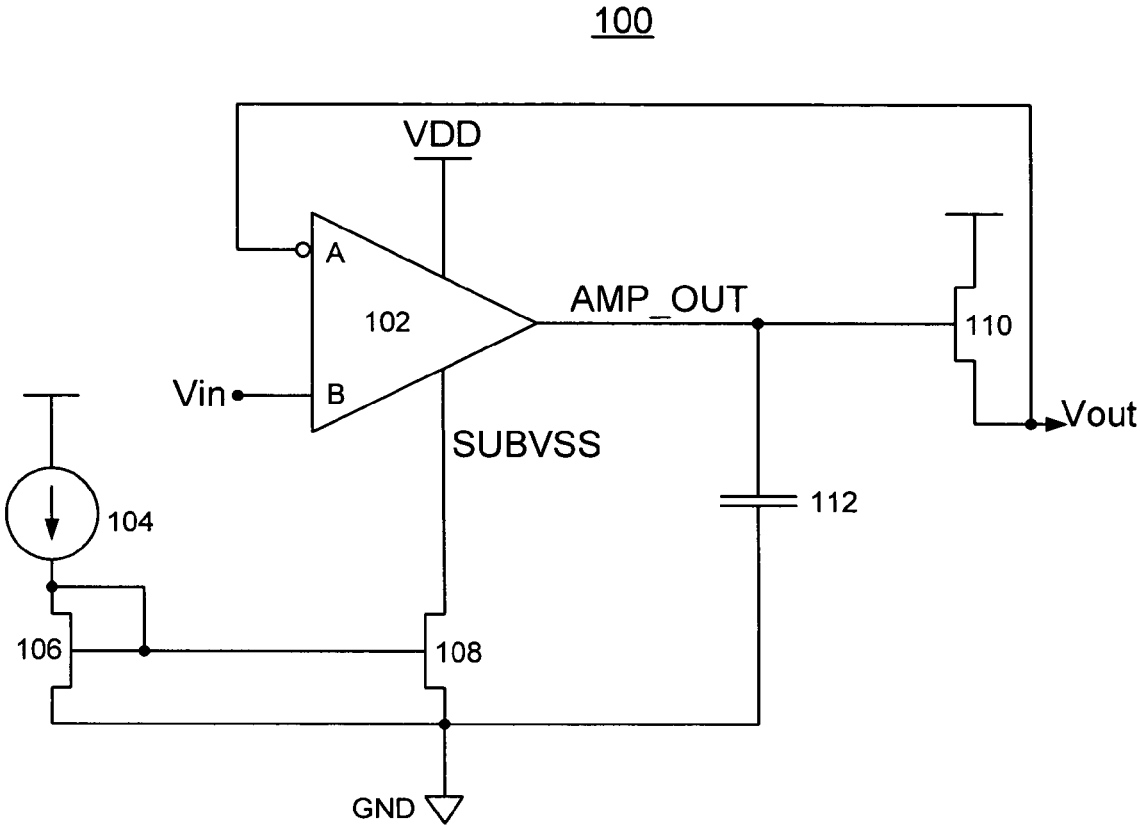
FIG. 1 is a schematic diagram illustrating a CMOS regulator for low headroom applications in accordance with the preferred embodiment.

Having reference now to the drawings, in FIG. 1 there is shown an exemplary CMOS regulator for low headroom applications in accordance with the preferred embodiment generally designated by the reference character 100.

Figure 2:
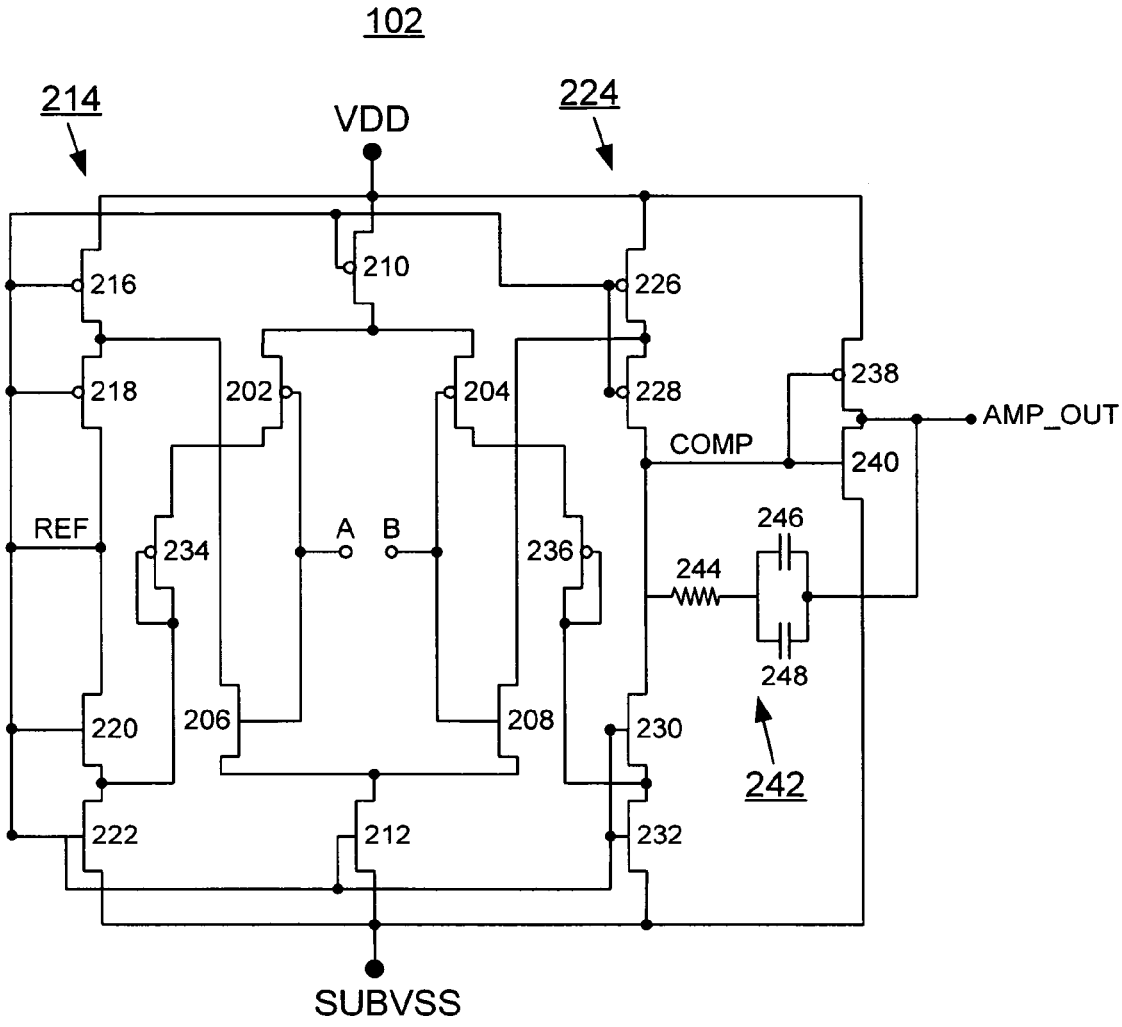
FIG. 2 is a schematic diagram illustrating an exemplary amplifier of the CMOS regulator of FIG. 1 in accordance with the preferred embodiment.

CMOS regulator 100 includes an amplifier 102 of the preferred embodiment, for example, as illustrated and described with respect to FIG. 2. CMOS regulator 100 includes a positive voltage supply rail VDD and a lower voltage node SUBVSS coupled to amplifier 102. CMOS regulator 100 is used at a low voltage power supply VDD, for example, 1.62 Volts. Amplifier 102 provides an output at a node labeled AMP_OUT. Amplifier 102 of the preferred embodiment is a wide input common mode range amplifier.

Amplifier 102 includes a pair of differential voltage inputs A and B. An output Vout of the CMOS regulator 100 is applied to the A input of the amplifier 102. A reference voltage Vin is applied to the B input of the amplifier 102. A current mirror arrangement includes a bias NMOS current source transistor 104 connected between the lower voltage node SUBVSS coupled to amplifier 102 and ground potential. An NMOS transistor 106 has a common drain and gate connection that is connected to a gate of the NMOS current source transistor 104. NMOS transistor 106 is connected between a reference current source 108 and ground. Amplifier 102 is biased by the NMOS current source transistor 104 to provide increased dynamic range and improved PSR at lower power supply voltages VDD.

CMOS regulator 100 includes an NMOS source follower transistor 110 having a gate connected to the output AMP_OUT of amplifier 102. NMOS source follower transistor 110 is connected between the positive voltage supply rail VDD and output Vout of the CMOS regulator 100. NMOS source follower transistor 110 provides the output Vout in a feedback loop to the A input of the amplifier 102. A decoupling capacitor 112 is connected between the output AMP_OUT of amplifier 102 and ground. NMOS source follower transistor 110 is arranged to be capable of supplying sufficient current at the output Vout of the CMOS regulator 100.

The reference current source 108 is arranged so that the current mirror bias NMOS current source transistor 104 drives approximately 1 mA through the amplifier 102 under low voltage conditions, such as, for the voltage supply rail VDD=1.62V. The common mode of the amplifier 102 is approximately 1.25V. At these conditions, node SUBVSS is approximately 50 mV and node AMP_OUT is approximately 1.55V.

Referring now to FIG. 2, there is shown an exemplary arrangement for the amplifier 102 of the CMOS regulator 100 in accordance with the preferred embodiment. Amplifier 102 includes a differential pair of P-channel field effect transistors (PFETs) 202, 204 and a differential pair of N-channel field effect transistors (NFETs) 206, 208.

A PFET 210 is connected between the positive voltage power supply VDD and a source of each of differential pair of PFETs 202, 204. An NFET 212 is connected between the lower voltage node SUBVSS of amplifier 102 and a source of each of differential pair of NFETs 206, 208. A gate of PFET 202 and a gate of NFET 206 are connected to the amplifier input A. A gate of PFET 204 and a gate of NFET 208 are connected to the amplifier input B.

A first CMOS transistor stack 214 generating a voltage reference at node labeled REF is connected between the positive voltage power supply VDD and the lower voltage node SUBVSS of the amplifier 102. The first transistor stack 214 includes a pair of series connected PFETs 216, 218 connected in series with a pair of series connected NFETs 220, 222. A source of PFET 216 is connected to the positive voltage power supply VDD and a source of NFET 222 is connected to the lower voltage node SUBVSS. A gate of PFET 218 and a gate of NFET 220 are connected to a common drain connection of PFET 218 and NFET 220 to configure diode connected devices. The voltage reference at node REF generated at the common drain connection of PFET 218 and NFET 220 is applied to a gate of each of the PFETs 216, 218, NFETs 220, 222, PFET 210, and NFET 212.

A second CMOS transistor stack 224 generating an output voltage at node labeled COMP is connected between the positive voltage power supply VDD and the lower voltage node SUBVSS of the amplifier 102. The second transistor stack 224 includes a pair of series connected PFETs 226, 228 connected in series with a pair of series connected NFETs 230, 232. A source of PFET 226 is connected to the positive voltage power supply VDD and a source of NFET 232 is connected to the lower voltage node SUBVSS.

The voltage reference at node REF generated at the common drain connection of PFET 218 and NFET 220 is applied to a gate of each of the PFETs 226, 228, and NFETs 230, 232 of the second transistor stack 224. With the voltage supply rail VDD=1.62V, node SUBVSS is approximately 50 mV and the voltage reference at node REF generated at the common drain connection of PFET 218 and NFET 220 is approximately 0.7 V.

A diode connected PFET 234 is connected between a drain of the differential pair PFET 202 and the drain and source connection of NFETS 220, 222 of the first transistor stack 214. A diode connected PFET 236 is connected between a drain of the differential pair PFET 204 and the drain and source connection of NFETS 230, 232 of the second transistor stack 224. PFETs 234, 236 are provided to limit the voltage drop across differential pair PFETs 202, 204.

A drain of differential pair NFET 206 is connected between a drain and source connection of first transistor stack PFETs 216, 218 defining a first main current path. A second main current path similarly is defined by connecting a drain of differential pair NFET 208 between a drain and source connection of second transistor stack PFETs 226, 228.

Amplifier 102 has the voltage output AMP_OUT provided by an inverter defined by a PFET 238 and an NFET 240. PFET 238 and an NFET 240 having a gate input of the output voltage at node COMP is connected between the positive voltage power supply VDD and the lower voltage node SUBVSS.

Amplifier 102 includes a frequency compensation circuit 242 connected between the node COMP and the amplifier voltage output AMP_OUT. Frequency compensation circuit 242 includes a resistor 244 connected between node COMP and a pair of parallel-connected capacitors 246, 248.

In the CMOS regulator 100 as shown in FIG. 1, the voltage input Vin at amplifier input B is a reference voltage, for example, a voltage input of 1.25 volts. For example, with a feedback path input A of 1.24 volts, where input A is less than input B or a positive differential voltage, the amplifier voltage output AMP_OUT is driven toward the positive voltage rail VDD. Otherwise where input A is greater than input B or a negative differential voltage, the amplifier voltage output AMP_OUT is driven toward the lower voltage node SUBVSS.

With the positive differential voltage where input B increases and is greater than input A, the current through differential pair NFET 208 increases, and the voltage at the drain of NFET 208 decreases. This decreases the current through PFET 228, dropping the voltage at node COMP and raising the voltage at AMP_OUT.

For example, with the voltage supply rail VDD=1.62V, node SUBVSS at approximately 50 mV and the voltage reference at node REF at approximately 0.7 V, and with input A at 1.24 V and input B at 1.25 V, then the voltage at node COMP is about 0.5 V and the voltage at AMP_OUT is about 1.55 V.

As shown in FIG. 1, the decoupling capacitor 112 can be implemented, for example, with a 68 pF capacitor. As shown in FIG. 2, each compensation capacitors 246, 248 has a capacitance in a range between 2–5 pF. For example, each compensation capacitors 246, 248 is implemented with a 3 pF capacitor with a 16 K ohm resistor for resistor 224.

Figure 3:
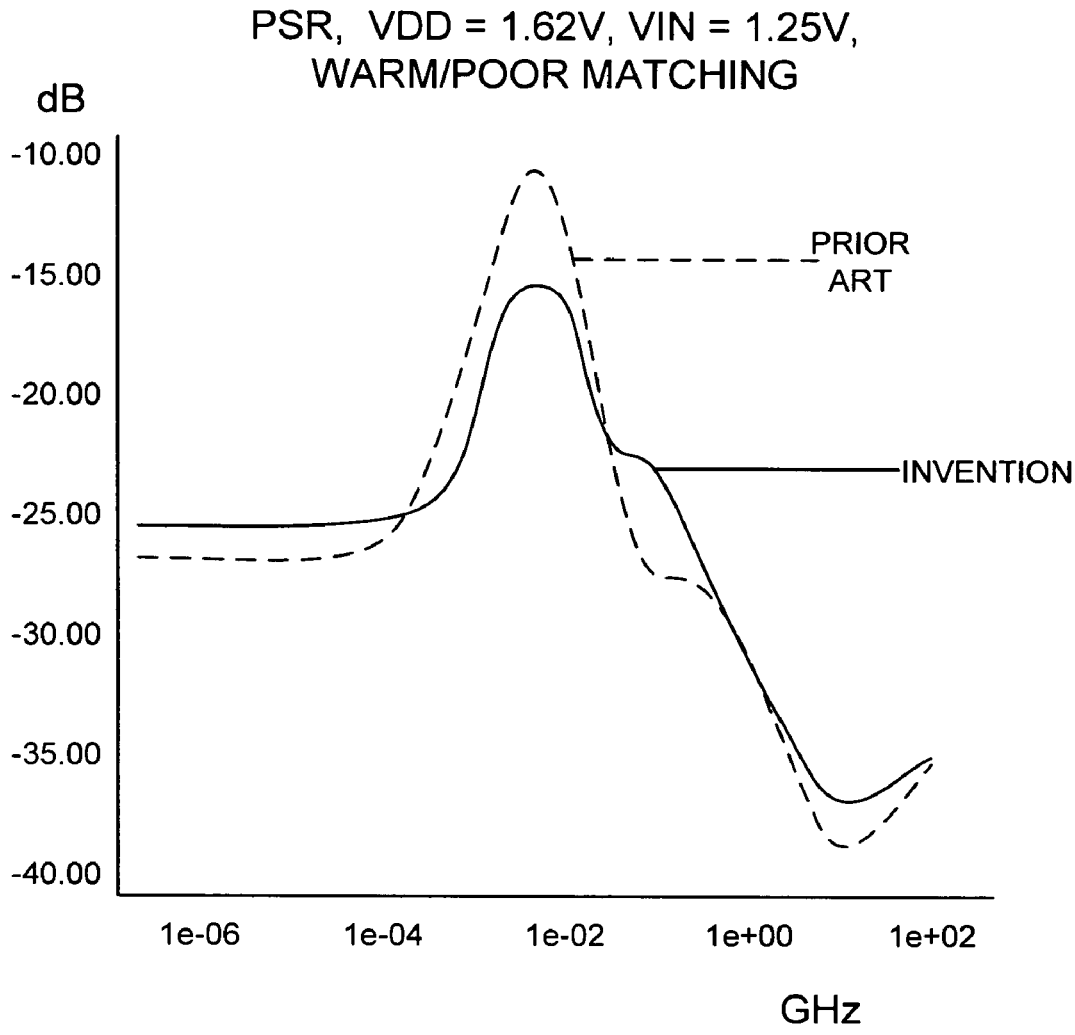
FIG. 3 is chart illustrating power supply rejection (PSR) of the CMOS regulator of FIG. 1 in accordance with the preferred embodiment for comparison with a prior art regulator including an NMOS source follower arrangement.

Referring now to FIG. 3, the exemplary plots illustrate PSR for the CMOS regulator 100 indicated by the solid line labeled INVENTION with a prior art regulator having the same NMOS source follower output arrangement indicated by a dotted line labeled PRIOR ART. In FIG. 3, the illustrated exemplary operation is for a warm temperature, such as 125° C., and with poor device matching for the CMOS regulator 100.

For CMOS regulator 100, as the current increases, the amplifier gain increases, and PSR improves or is lower. For example, as shown in the simulation of FIG. 3, a maximum PSR of the CMOS regulator 100 of the preferred embodiment is 3 to 6 dB lower than the prior art regulator design at a voltage supply rail VDD of 1.62V. Note Vin is approximately 1.25V, this is significant when the PSR is greater than or equal to −20 dB. In the illustrated example, the maximum PSR of the conventional regulator is −10.5 dB, the PSR of the new regulator 100 is −16 dB. In cases with more headroom, for example, with 1.8V or 1.9V for VDD, the PSR for both illustrated regulators of FIG. 3 stayed below −20 dB.

While the present invention has been described with reference to the details of the embodiments of the invention shown in the drawing, these details are not intended to limit the scope of the invention as claimed in the appended claims.

What is claimed is:

1. A complementary metal oxide semiconductor (CMOS) voltage regulator for low headroom applications comprising:

a differential input common mode range amplifier; said differential input common mode range amplifier being formed by a plurality of CMOS transistors; said differential input common mode range amplifier including a first differential pair of CMOS transistors and a second differential pair of CMOS transistors; said first differential pair of CMOS transistors including a differential pair of P-channel field effect transistors (PFETs) and said second differential pair of CMOS transistors including a differential pair of N-channel field effect transistors (NFETs); a first differential input coupled to a first PFET of said differential pair of PFETs and a first NFET of said differential pair of NFETs; and a second differential input coupled to a second PFET of said differential pair of PFETs and a second NFET of said differential pair of NFETs;

a source follower CMOS transistor coupled to an output of said differential input common mode range amplifier for providing an output of the CMOS voltage regulator; and a current source coupled to said differential input common mode range amplifier for maintaining a bias current through said differential input common mode range amplifier.

2. A CMOS voltage regulator as recited in claim 1 wherein said differential input common mode range amplifier receives a bias voltage input and a feedback output voltage input from said source follower CMOS transistor.

3. A CMOS voltage regulator as recited in claim 1 includes a third PFET coupled between a positive voltage supply rail VDD and said first differential pair of PFETs and a third NFET coupled between said second differential pair of NFETs and a lower voltage node SUBVSS.

4. A CMOS voltage regulator as recited in claim 1 includes a first CMOS transistor stack generating a voltage reference; said first CMOS transistor stack connected between a positive voltage power supply VDD and a lower voltage node SUBVSS.

5. A CMOS voltage regulator as recited in claim 1 includes a decoupling capacitor; said decoupling capacitor connected between said output of said differential input common mode range amplifier and a ground potential.

6. A CMOS voltage regulator as recited in claim 1 wherein said current source coupled to said differential input common mode range amplifier for maintaining a bias current through said differential input common mode range amplifier includes a current mirror arrangement; said current mirror arrangement includes a first bias NMOS current source transistor connected between a lower voltage node SUBVSS and ground potential; a second NMOS transistor having a common drain and gate connection that is connected to a gate of the first NMOS current source transistor and said second NMOS transistor connected between a reference current source and ground potential.

7. A CMOS voltage regulator as recited in claim 1 wherein said source follower CMOS transistor coupled to said output of said differential input common mode range amplifier for providing an output of the CMOS voltage regulator includes an NMOS source follower transistor.

8. A complementary metal oxide semiconductor (CMOS) voltage regulator voltage regulator for low headroom applications comprising:

a differential input common mode range amplifier; said differential input common mode range amplifier being formed by a plurality of CMOS transistors;

a source follower CMOS transistor coupled to an output of said differential input common mode range amplifier for providing an output of the CMOS voltage regulator;

a current source coupled to said differential input common mode range amplifier for maintaining a bias current through said differential input common mode range amplifier; and a first CMOS transistor stack generating a voltage reference: said first CMOS transistor stack connected between a positive voltage power supply VDD and a lower voltage node SUBVSS; said first CMOS transistor stack includes a pair of series connected PFETs connected in series with a pair of series connected NFETs between the positive voltage power supply VDD and the lower voltage node SUBVSS.

9. A CMOS voltage regulator as recited in claim 8 includes a second CMOS transistor stack generating an output voltage; said second CMOS transistor stack connected between the positive voltage power supply VDD and the lower voltage node SUBVSS.

10. A CMOS voltage regulator as recited in claim 9 wherein said second transistor stack includes a pair of series connected PFETs connected in series with a pair of series connected NFETs connected between the positive voltage power supply VDD and the lower voltage node SUBVSS.

11. A CMOS voltage regulator as recited in claim 10 wherein said second differential pair of NFETs includes a respective drain connected to a drain and source connection of said respective pair of series connected PFETs of said first transistor stack and said second transistor stack.

12. A CMOS voltage regulator as recited in claim 10 includes an inverter defined by a PFET and an NFET; said PFET and said NFET connected between the positive voltage power supply VDD and the lower voltage node SUBVSS and having a gate input of the output voltage of said second transistor stack.

13. A CMOS voltage regulator as recited in claim 12 includes a frequency compensation circuit connected between the output voltage of said second transistor stack and an output of the inverter.

14. A CMOS voltage regulator as recited in claim 13 wherein said frequency compensation circuit includes a resistor and a capacitor connected in series between the output voltage of said second transistor stack and an output of the inverter.

* * * * *